United States Patent [19]

Dragonuk

[11] 4,263,835

[45] Apr. 28, 1981

[54] SONOBUOY LAUNCHER SYSTEM

[75] Inventor: Leo Dragonuk, Plymouth Meeting, Pa.

[73] Assignee: The United States of America as represented by the Secretary of the Navy, Washington, D.C.

[21] Appl. No.: 15,828

[22] Filed: Feb. 28, 1979

[51] Int. Cl.[3] ..... F41F 5/02; B64D 1/04

[52] U.S. Cl. ..... 89/1.5 R; 89/1 F; 89/1.806; 89/1.818

[58] Field of Search ..... 89/1.5 R, 1.5 F, 1 E, 89/1 L, 1 F, 1.806, 1.809, 1.810, 1.814, 1.816, 1.818; 244/137 R; 102/37.6

[56] References Cited

U.S. PATENT DOCUMENTS

| | | | |
|---|---|---|---|
| 3,072,022 | 1/1963 | Wood et al. | 89/1.806 |
| 3,088,377 | 5/1963 | Siegel | 89/1.818 X |
| 3,158,062 | 11/1964 | Feiler | 89/1.818 X |
| 3,451,306 | 6/1969 | Lagerstrom et al. | 89/1.5 R X |
| 3,662,645 | 5/1972 | Thurston et al. | 89/1.5 R |
| 3,779,128 | 12/1973 | Pelaez | 89/1.806 X |
| 3,808,941 | 5/1974 | Biggs | 89/1.5 R |
| 4,019,421 | 4/1977 | Ström | 89/1.5 R |
| 4,026,188 | 5/1977 | Woodruff et al. | 89/1.5 R |
| 4,040,334 | 8/1977 | Smethers | 89/1.818 X |
| 4,164,887 | 8/1979 | Ouellette | 89/1.5 R |

*Primary Examiner*—David H. Brown

*Attorney, Agent, or Firm*—R. S. Sciascia; Henry Hansen

[57] ABSTRACT

A pneumatic restraint and ejection system for a multiple sonobuoy launcher having a single plenum communicating through separate clack valves to the inboard ends of a plurality of launcher tubes and through separate girdle valves to inflatable girdles about the launch tubes. After sonobuoys are inserted into the launch tubes, the plenum is charged with compressed air with the clack and girdle valves positioned to impart an ejection force on the backs and a longitudinal restraining force on sides of the sonobuoys. A sonobuoy is ejected by actuating the girdle valve to shut off the plenum air to the girdle and to exhaust the air in the girdle. As the sonobuoy leaves its launch tube, the air behind the sonobuoy expands causing a sudden differential pressure between the plenum and the tube to cause the clack valve to close and prevent loss of plenum pressure through the empty launch tube. In one embodiment, the launch tube includes a solonoid actuated latch at the discharge end which secures the sonobuoy therein. Actuation of the solonoid simultaneously releases the latch and operates the girdle valve. In another embodiment, three sonobuoys are loaded in tandem within a single launch tube. Three pressure chambers and girdles are separately actuated by solonoid-actuated girdle valves for sequential ejection of the sonobuoys.

8 Claims, 2 Drawing Figures

SONOBUOY LAUNCHER SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates to store launcher systems, and more particularly to a pneumatic girdle restraint and ejection system for launching ASW (anti-submarine warfare) sonobuoys. ASW aircraft are predominantly equipped with sonobuoy launcher systems which utilize cartridge-activated devices, such as pyrotechnic squibs or high-pressure gas bottles, as the energy source for ejecting the sonobuoys. Gas is discharged at high pressure for high reactive loads at low volume entailing very sophisticated breech and firing mechanisms within separate metal, plastic or filament-wound fiberglass sonobuoy launch containers. Consequently, each type of sonobuoy requires a unique and costly container externally configured to fit in a standard size launch tube, but internally configured to fit one of several size sonobuoys and interface with its corresponding breech and firing mechanisms. After one ejection, the containers are usually thrown away because the cost of recycling them exceeds their original cost.

SUMMARY OF THE INVENTION

Accordingly, it is an object of the present invention to provide a store launcher which obviates the need for a separate launch container and specialized breech and firing mechanisms therefor. Other objects are to provide a store launcher utilizing compressed air at relatively low pressure and large volume for ejecting the stores at reduced working pressures, which allows the ejection force to be applied before launching against the back of the store while longitudinally restraining the store within the launch tube, and which enables the store to be immediately ejected upon releasing the longitudinal restraint. Another object is to provide a store launcher which is relatively simple to manufacture and maintain and which is of reduced overall installation weight.

Briefly, these and other objects of the invention are accomplished by a store launcher having a plenum charged with relatively low pressure gas communicating through a normally open clack valve with the breech or inboard end of the launcher, and through a two-way valve to an inflatable girdle about the launcher for longitudinally restraining a store therewithin. An electrical circuit causes the two-way valve to shut off the gas from the plenum and depressurize the girdle and allows the store to be ejected. As the store discharges, the pressure drop in the launcher causes the clack valve to close preventing the charged gas from escaping through the launcher.

For a better understanding of these and other objects and aspects of the invention, reference may be made to the following detailed description taken in conjunction with the accompanying drawings wherein:

DESCRIPTION OF THE PREFERRED EMBODIMENT

Figure 1:
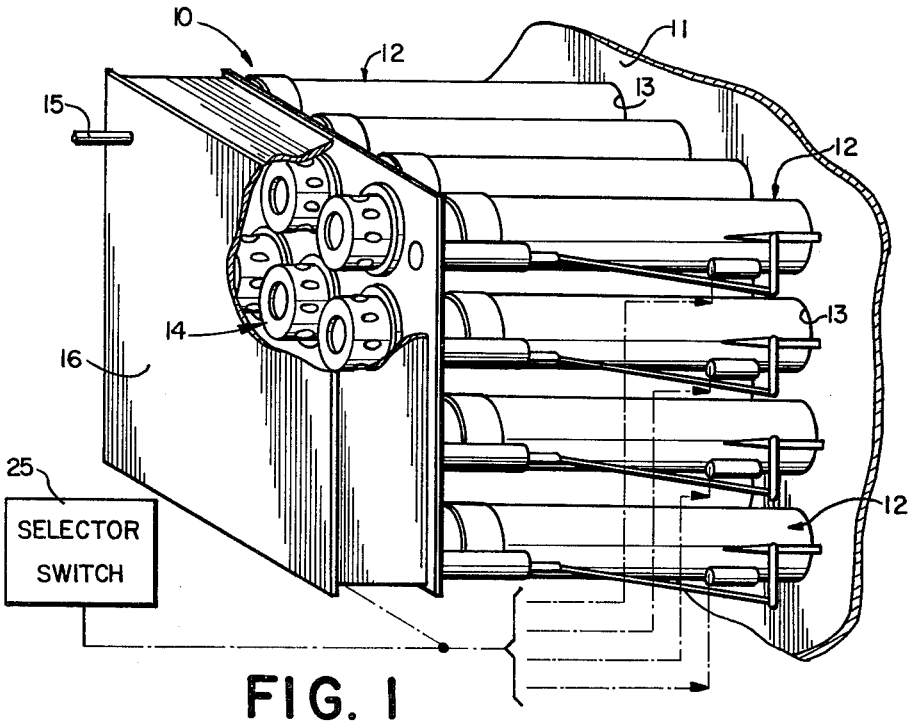
FIG. 1 is an isometric view from within an aircraft of one embodiment of a multiple sonobuoy launcher system according to the invention for retaining and selectively ejecting sonobuoys therefrom.
Figure 2:
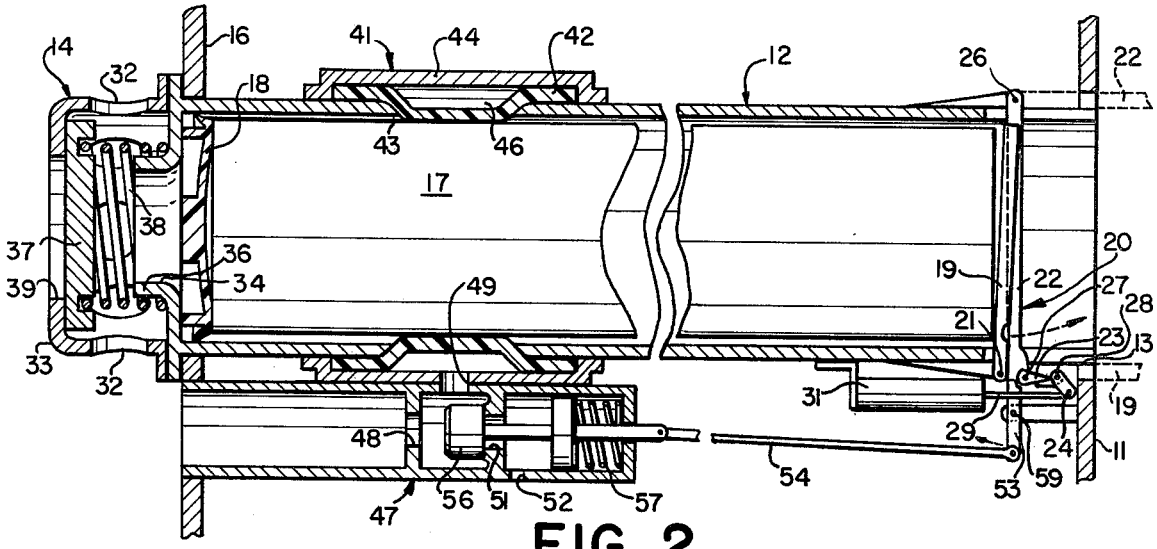
FIG. 2 is a longitudinal, cross-sectional view of one sonobuoy launcher in the system of FIG. 1.

Referring now to the drawings wherein like characters designate like or corresponding parts throughout the several views, there is shown in FIG. 1 a sonobuoy launcher system 10 mounted in the side 11 of the fuselage of an ASW aircraft such as a helicopter. The system 10 includes a matrix of launch tubes 12, each having its discharge end exteriorally communicating through a corresponding fuselage opening 13 and its breech or inboard end communicating through a clack valve 14 with a sealed plenum 16. An inlet conduit 15 delivers compressed air from the aircraft compressor (not shown) to plenum 16 at the pressure required to produce a suitable ejection force to the sonobuoy. Each launch tube 12 is selectively activated by a selector switch 25. As shown in FIG. 2, a sonobuoy 17 is positioned at the inboard end against a circular obturator 18 sealingly interposed between the sonobuoy and the end of each tube 12. The obturator 18 is preferably constructed of a flexible plastic slidable along the length of the tube while maintaining the pressurized integrity of plenum against air escaping along the sides of the sonobuoy 17. The outboard end of sonobuoy 17 is positioned against a latch mechanism 20 including a channeled hinge 19, hasp 22, sear 23 and cam 24 which pivots about pins 21, 26, 27 and 28, respectively, fixed relative to tube 12. Cam 24 is rotated clockwise about pin 28 by a reciprocatable rod 29 connected to a solonoid actuator 31. Electrically energizing solonoid 31 rotates cam 24 clockwise about pin 28 and disengages sear 27. Hasp 22 is then free to rotate counterclockwise about pin 26 releasing hinge 19 for clockwise rotation about pin 21. Hinge 19 and hasp 22 are now free to pivot out of tube 12 into notches 22 and 23, respectively, providing thereby an unobstructed discharge opening for the sonobuoy 17.

Clack valve 14 is normally open to apply pressurized air within plenum 16 through side openings 32 of a valve cage 33 and through an orifice 34 at the inboard end of tube 12 to the inboard surface of the obturator 18. Orifice 34 includes a valve seat 36 extending from tube 12 and registers with member 37 which is urged away from the valve seat 36 and against cage 33 by a compression spring 38. Another opening 39 in cage 33 opposite of closure member 37 provides plenum pressure equalization on either side thereof. Sudden movement of the obturator 18 upon ejection of the sonobuoy 17 will produce a pressure differential across member 37 sufficient to oppose the force of spring 38 and seat it against seat 36 and close orifice 34. Member 37 will remain seated after ejection due to the sustained pressure differential across member 37.

Intermediate of the ends of tube 12 there is an inflatable girdle 41 having a rubber or similarly elastic ring 42 sealingly encircling an annular slot 43 in tube 12. An outer ring 44 about elastic ring 43 forms an inflatable chamber 46 therebetween and also provides rigid support of tube 12 on either side of slot 43. Compressed air from plenum 16 communicates with inflatable chamber 46 through ports 48 and 49 of a two-way valve 47. When sonobuoy 17 is fully inserted in tube 12 and secured by latch mechanism 20, one end of a lever 53 engages sear 23. The other end is connected by a rod 54 to a valve element 56 to close port 51 against the force of a compression spring 57 with valve 47. Upon selectively energizing solonoid 31 by switch 25, hasp 22 is released to allow lever 53 to rotate about fixed pin 59. Element 56 can now move under the force of spring 57 and exhaust chamber 46 through ports 51 and 52, and close inlet port 48.

Operation of the embodiment of FIGS. 1 and 2 is summarized as follows. The air pressure in plenum 16 is reduced to atmospheric so that clack valves 14 are open. An obturator 18 and sonobuoy 17 is fully inserted in each tube 12 from the discharge end thereof. Lever 53 is rotated counterclockwise against the force of spring 57 to open port 48 and close port 51 of valve 47. Hinge 19 and hasp 22 are latched by lever 53 upon clockwise rotation of sear 23 into the notch of cam 24. The plenum 16 may be pressurized while in flight by the aircraft's air compressors to the required pressure for sonobuoy ejection, for example 60 psi. As the plenum pressure increases and exerts an ejection force against obturator 18, the compressed air also passes through valve 47 to girdle 41 to exert a longitudinal restraining force on the sonobuoy 17. At the required plenum pressure, all of the launcher tubes 12 are fully charged for ejecting sonobuoys 17. When the aircraft has reached station for deployment of a sonobuoy, selector switch 25 is operated to energize the corresponding solonoid 31. Latch mechanism 20 is released and valve 47 exhausts the chamber 46 of the girdle 41 in the manner described above. Longitudinal restraint on the sonobuoy being removed, the plenum pressure against obturator 18 causes sonobuoy 17 to eject. The sudden drop in pressure at orifice 34 closes the clack valve 14 to prevent loss of compressed air from plenum 16. The remaining sonobuoys are ejected in the same manner when their respective solonoids 31 are actuated by selector switch 25.

Some of the many advantages and novel features of the invention should now be apparent. For example, a store launching system is provided which enables direct insertion of a sonobuoy within the launch tube obviating requirements for a sonobuoy launch container and the logistical problems of disposal or recycling, and which utilizes restraint and ejection components operating at relatively low gas pressures. The system is inherently lighter in weight because the need for heavy duty, high pressure components is eliminated. A large capacity energy source may be charged at relatively low gas pressures from the aircraft compressor while in flight.

It will be understood that various changes in the details, steps and arrangements of parts, which have been herein described and illustrated in order to explain the nature of the invention, may be made by those skilled in the art within the principle and scope of the invention as expressed in the appended claims.

I claim:

1. An improved launcher for restraining and ejecting a store contained therein, comprising:

plenum means formed to receive a charge of compressed gas;

tube means formed to receive store in one end and connected to said plenum to receive said gas for urging the store out of said tube means, said tube means including an inflatable girdle means intermediate the ends thereof formed to receive compressed gas for longitudinally restraining the store; and deflating means operatively connected to said girdle means for selectively depressurizing the gas therein, whereby the compressed gas in said tube means ejects the store.

2. An improved launcher according to claim 1 wherein said tube means further includes:

valve means responsive to the pressure differential between said plenum means and said tube means for shutting off the compressed gas in said plenum means after the store is ejected.

3. An improved launcher according to claim 2 wherein: said tube means includes a cylinder having an opening adjacent to said girdle means; and said girdle means includes an elastic member secured to said tube means at said opening and an enclosure forming a sealed chamber for expanding said member into said tube against the store in response to the compressed gas received in said girdle means.

4. An improved launcher according to claim 3 wherein: said valve means includes an orifice in said tube means for passing the plenum air to said tube means, a closure element responsive to the pressure differential justapositioned for closing said orifice, and resilient means operatively connected to said tube means for urging said closure element to open said orifice.

5. An improved launcher according to claim 4 wherein:

said valve further includes a cage fixed to said tube means for limiting the open position of said closure element.

6. An improved launcher according to claim 4 wherein: said deflating means includes a valve means for shutting off the compressed air to said girdle means and depressurizing said chamber.

7. An improved launcher according to claim 6 further comprising:

latch means operatively connected to said one end of said tube means for retaining the store in said tube means; and actuator means operatively connected to said latch means and said deflating means for simultaneously releasing the store and actuating said valve means to the depressurizing position.

8. An improved launcher according to claim 7 further comprising:

obturator means formed to be interposed between the back of the store and the other end of said tube means and slidable therein for confining the compressed air.

* * * * *